US011466872B2

(12) United States Patent
Clark et al.

(10) Patent No.: US 11,466,872 B2
(45) Date of Patent: Oct. 11, 2022

(54) MODULAR HEAT PUMP SYSTEM

(71) Applicant: Trane International Inc., Davidson, NC (US)

(72) Inventors: Mark S. Clark, Tyler, TX (US); Franklin K. Rolles, Denver, NC (US); Qiao Tian, Tyler, TX (US); Jeffrey L. Stewart, Whitehouse, TX (US); Jin Min Sun, Su Zhou (CN)

(73) Assignee: Trane International Inc., Davidson, NC (US)

( * ) Notice: Subject to any disclaimer, the term of this patent is extended or adjusted under 35 U.S.C. 154(b) by 262 days.

(21) Appl. No.: 16/794,610

(22) Filed: Feb. 19, 2020

(65) Prior Publication Data

US 2020/0182489 A1 Jun. 11, 2020

Related U.S. Application Data

(63) Continuation of application No. 15/729,375, filed on Oct. 10, 2017, now abandoned.

(51) Int. Cl.
*F24F 1/027* (2019.01)
*F24F 11/56* (2018.01)
(Continued)

(52) U.S. Cl.
CPC ..... *F24F 1/027* (2013.01); *F24F 11/30* (2018.01); *F24F 11/56* (2018.01); *F24F 11/70* (2018.01);
(Continued)

(58) Field of Classification Search
CPC .. F24F 1/027; F24F 11/30; F24F 11/56; F24F 11/70; F24F 11/64; F24F 11/83; F24F 2110/10; F24F 2110/20
See application file for complete search history.

(56) References Cited

U.S. PATENT DOCUMENTS 2,363,191 A 11/1944 Miller
2,662,743 A 12/1953 Frenger
(Continued)

FOREIGN PATENT DOCUMENTS

FR 1303675 9/1962
JP 61213529 9/1986
(Continued)

*Primary Examiner* — Larry L Furdge
(74) *Attorney, Agent, or Firm* — Womble Bond Dickinson (US) LLP

(57) ABSTRACT

An HVAC system utilizes one or more modular heat pump units installed within an outer wall or corner of a building, and one or more active registers. A central hub, which can be integrated into a modular HVAC unit, receives input from thermostats and sensors in the building and adjusts operation of the modular HVAC units and active registers to distribute conditioned air throughout the building. The system provides convenience and comfort of a traditional split HVAC system with significantly reduced installation and maintenance costs. The modular HVAC unit includes an interchangeable cartridge that contains the active components of a heat pump. Cartridges of different capacities can be installed as required, and are easily swapped out for maintenance, servicing, and replacement. A user can control the system using traditional-style thermostats and with a smart phone, tablet or computer. A cloud server provides backup services and remote access to the system.

19 Claims, 13 Drawing Sheets

(51) Int. Cl.

| | |
|---|---|
| ***F24F 11/30*** | (2018.01) |
| ***F24F 11/70*** | (2018.01) |
| *F24F 11/64* | (2018.01) |
| *F24F 110/20* | (2018.01) |
| *F24F 110/10* | (2018.01) |
| *F24F 11/83* | (2018.01) |

(52) U.S. Cl.
CPC ..... *F24F 11/64* (2018.01); *F24F 11/83* (2018.01); *F24F 2110/10* (2018.01); *F24F 2110/20* (2018.01)

(56) References Cited

U.S. PATENT DOCUMENTS

| | | | | |
|---|---|---|---|---|
| 2,724,044 | A | 11/1955 | Campbell | |
| 3,128,610 | A | 4/1964 | Moore | |
| 3,217,450 | A | 11/1965 | Brownstein | |
| 3,308,634 | A * | 3/1967 | Smith | F24F 13/20 62/263 |
| 3,449,838 | A | 6/1969 | Chancellor, Jr. | |
| 3,722,580 | A | 3/1973 | Braver | |
| 3,908,750 | A | 9/1975 | Siegel | |
| 4,013,120 | A | 3/1977 | Rheinheimer | |
| 4,067,204 | A | 1/1978 | Riello | |
| 4,072,187 | A | 2/1978 | Lodge | |
| 4,373,576 | A | 2/1983 | Strupczewski | |
| 4,505,328 | A | 3/1985 | Schmitt | |
| 4,523,630 | A | 6/1985 | Wiklund | |
| 4,544,023 | A * | 10/1985 | Marciniak | F24F 1/022 165/57 |
| 4,573,328 | A | 3/1986 | Bolton et al. | |
| 4,637,223 | A | 1/1987 | Hosoya et al. | |
| 4,739,627 | A | 4/1988 | Baumann | |
| 4,811,570 | A * | 3/1989 | Jennings | F24F 13/24 62/263 |
| 4,942,348 | A | 7/1990 | Nilssen | |
| 4,958,500 | A | 9/1990 | Kuroda et al. | |
| 5,036,677 | A | 8/1991 | Neuenfeldt et al. | |
| 5,095,716 | A | 3/1992 | You | |
| 5,187,950 | A | 2/1993 | Weldon | |
| 5,277,036 | A | 1/1994 | Dieckmann et al. | |
| 5,301,744 | A * | 4/1994 | Derks | F24F 13/20 165/59 |
| 5,361,981 | A | 11/1994 | Albert et al. | |
| 5,377,503 | A | 1/1995 | Reedy et al. | |
| 5,485,878 | A | 1/1996 | Derks | |
| 5,489,238 | A | 2/1996 | Asselbergs | |
| 5,533,668 | A | 7/1996 | Erikson | |
| 5,657,641 | A | 8/1997 | Cunningham et al. | |
| 5,711,480 | A | 1/1998 | Zepke et al. | |
| 5,857,353 | A | 1/1999 | Schneider et al. | |
| 5,987,908 | A | 11/1999 | Wetzel | |
| 6,134,109 | A | 10/2000 | Muller et al. | |
| 6,185,943 | B1 | 2/2001 | Kopko | |
| 6,367,280 | B1 | 4/2002 | Funabasama et al. | |
| 6,481,228 | B1 | 11/2002 | Chiang et al. | |
| 6,532,952 | B1 | 3/2003 | Kreamer | |
| 6,692,349 | B1 | 2/2004 | Brinkerhoff et al. | |
| 6,701,741 | B2 | 3/2004 | Liu | |
| 6,725,915 | B2 | 4/2004 | Wheat et al. | |
| 6,742,582 | B1 | 6/2004 | Wheat et al. | |
| 6,763,669 | B1 | 7/2004 | Bushnell et al. | |
| 6,792,766 | B2 | 9/2004 | Osborne et al. | |
| 7,014,124 | B2 | 3/2006 | Gottlieb | |
| 7,100,597 | B2 | 9/2006 | Rand | |
| 7,124,601 | B2 | 10/2006 | Kim et al. | |
| 7,163,156 | B2 | 1/2007 | Kates | |
| 7,258,606 | B1 | 8/2007 | Reid | |
| 7,337,626 | B2 | 3/2008 | Lee | |
| 7,347,774 | B2 | 3/2008 | Aronstam et al. | |
| D566,820 | S | 4/2008 | Kim et al. | |
| 7,533,716 | B2 | 5/2009 | Bianco | |
| 7,596,960 | B2 | 10/2009 | Bae | |
| 7,603,873 | B2 | 10/2009 | Tonin | |
| 7,604,043 | B2 | 10/2009 | Higashida et al. | |
| 7,832,465 | B2 | 11/2010 | Zou et al. | |
| 7,966,837 | B2 | 6/2011 | El-Galley et al. | |
| 7,987,023 | B2 | 7/2011 | Bush et al. | |
| 8,047,448 | B1 | 11/2011 | Miller et al. | |
| 8,057,565 | B2 | 11/2011 | Yabu et al. | |
| 8,320,120 | B1 | 11/2012 | Chan et al. | |
| 8,322,155 | B2 | 12/2012 | Tutunoglu et al. | |
| 8,356,659 | B2 | 1/2013 | Zheng et al. | |
| 8,550,370 | B2 | 10/2013 | Barrett et al. | |
| 8,850,832 | B2 | 10/2014 | Lingrey et al. | |
| 8,887,392 | B1 | 11/2014 | Xu et al. | |
| D726,295 | S | 4/2015 | Kim et al. | |
| 9,115,926 | B2 | 8/2015 | Rothmund et al. | |
| 9,303,890 | B2 | 4/2016 | Haines et al. | |
| 9,535,408 | B2 | 1/2017 | Lingrey et al. | |
| 2002/0157415 | A1 | 10/2002 | Liu | |
| 2007/0051244 | A1 | 3/2007 | Chang | |
| 2007/0125111 | A1 | 6/2007 | Xiao | |
| 2007/0293139 | A1 | 12/2007 | Vacek | |
| 2009/0031744 | A1 | 2/2009 | D'souza | |
| 2009/0107162 | A1 | 4/2009 | Su et al. | |
| 2010/0012737 | A1 | 1/2010 | Kates | |
| 2010/0057259 | A1 | 3/2010 | Dawson et al. | |
| 2010/0084124 | A1 | 4/2010 | Franaszek | |
| 2011/0015802 | A1 | 1/2011 | Imes | |
| 2011/0031322 | A1 | 2/2011 | Zou et al. | |
| 2011/0034118 | A1 | 2/2011 | Franaszek et al. | |
| 2011/0198404 | A1 | 8/2011 | Dropmann | |
| 2013/0037252 | A1 | 2/2013 | Major et al. | |
| 2013/0334326 | A1 | 12/2013 | Shan | |
| 2014/0000861 | A1 | 1/2014 | Barrett et al. | |
| 2015/0245532 | A1 | 8/2015 | Clancy et al. | |
| 2015/0273382 | A1 | 10/2015 | Stoner et al. | |
| 2015/0369511 | A1 | 12/2015 | Johnson et al. | |
| 2016/0047559 | A1 | 2/2016 | Swanson | |
| 2016/0091220 | A1 | 3/2016 | Kates | |
| 2016/0320078 | A1 | 11/2016 | Milder et al. | |
| 2016/0320083 | A1 | 11/2016 | Windgassen | |

FOREIGN PATENT DOCUMENTS

| | | |
|---|---|---|
| JP | 02230032 | 9/1991 |
| JP | 2001141298 | 5/2001 |
| WO | 2001007837 | 2/2001 |
| WO | 2013040670 | 3/2013 |

* cited by examiner

MODULAR HEAT PUMP SYSTEM

CROSS-REFERENCE TO RELATED APPLICATION

This application is a Continuation of U.S. Utility patent application Ser. No. 15/729,375 entitled "MODULAR HEAT PUMP SYSTEM" and filed Oct. 10, 2017, the entirety of which is hereby incorporated by reference herein for all purposes.

BACKGROUND

1. Technical Field

The present disclosure relates generally to heating, ventilation, and air conditioning (HVAC) systems, and in particular, to a modular packaged heat pump system that requires no special HVAC skills or certifications to install.

2. Background of Related Art

Installing an HVAC system can be complicated, time-consuming and expensive in new construction, and even more so in an old construction retro-fit. The system components must be carefully selected to deliver the required heating and cooling capacity. Air delivery and return ductwork must be planned and installed throughout the building. Depending on building architecture, this can be a challenging task and require encroachments into living and storage space in the form of dropped ceilings, boxed-in soffits, reduced closet space, reduced attic space, and so forth. Refrigerant lines must be run between the outdoor unit (which includes a compressor, fan, and outdoor heat exchanger coil) and the indoor unit (which includes a blower and indoor heat exchanger coil). A certified technician is required to purge, evacuate, and charge the system with refrigerant in accordance with strict technical and regulatory standards. Multiple electrical and control wiring runs are needed to connect HVAC components to power and to each other. In the case of buildings that use multiple HVAC zones, the entire installation process is repeated two, three, or more times.

This approach can have drawbacks. The availability of skilled and certified HVAC technicians is often in short supply, leading to construction delays and increased installation costs. Improper HVAC sizing and ductwork design can lead to overly hot or cold rooms. Repair and replacement of the outdoor unit or indoor unit can be inconvenient and costly. Once the system is fully installed, there is little or no flexibility to revise the system without incurring substantial cost and inconvenience.

An HVAC system that addresses these shortcomings would be a welcome advance in the art.

SUMMARY

In one aspect, the present disclosure is directed to an in-wall enclosure for mounting a modular HVAC cartridge. The in-wall enclosure is dimensioned to fit within a space between an exterior sheathing of a building, a first vertical wall stud, and a second vertical wall stud. The enclosure includes an indoor duct opening and an outdoor duct opening, an outdoor air inlet, and a front opening that exposes a cavity which can receive a modular HVAC cartridge. An indoor duct may extend from the indoor duct opening to an indoor duct outlet. Additionally or alternatively to the indoor duct, an outdoor duct may from the outdoor duct opening to an outdoor duct outlet. In some embodiments, the enclosure includes an outlet port through which condensate, e.g., water generated from the dehumidification of air, is expelled. The in-wall enclosure may include an electrical connector disposed in the cavity. The electrical connector may be designed to electrically engage a mating connector provided on a modular HVAC cartridge when the modular HVAC cartridge is positioned in the in-wall enclosure.

In another aspect, the present disclosure is directed to a modular HVAC cartridge. The cartridge includes a housing having at least a rear side, a top side, and a front side. The cartridge housing is sized to mate with the cavity of the in-wall enclosure described above. The cartridge includes an indoor air port that is configured to mate with the indoor duct of the in-wall enclosure. Additionally or alternatively, the cartridge includes an outdoor air port that is configured to mate with the outdoor duct of the in-wall enclosure. The cartridge includes an indoor air inlet and an outdoor air inlet. An indoor coil is disposed between the indoor air inlet and the indoor air port and an outdoor coil disposed between the outdoor air inlet and the outdoor air port. The cartridge includes an indoor fan for moving indoor air from the indoor air inlet to the indoor air port and an outdoor fan for moving outdoor air from the outdoor air inlet to the outdoor air port. A refrigerant compressor is in fluid communication with the indoor coil and the outdoor coil to perform a vapor-compression refrigeration cycle. The cartridge may include a reversing valve to enable cooling (air conditioning) or heating (heat pump) operation.

In some embodiments, the HVAC cartridge includes an indoor condensate pan positioned beneath the indoor coil and/or an outdoor condensate pan positioned beneath the outdoor coil. A drain pipe having an upper end and a lower end may be included, wherein the upper end is in fluid communication with the indoor condensate pan, and wherein the lower end is in fluid communication with the outdoor condensate pan, to enable fluid to drain from the upper pan into the lower pan.

In some embodiments, the HVAC cartridge includes a control module. The control module includes a communications interface and controller unit having a processor and a memory. The memory stores instructions executable by the processor which, when executed by the processor, cause the processor to adjust the operation of the indoor fan, the outdoor fan, and/or the compressor. In some embodiments, the memory further includes instructions executable by the processor which, when executed by the processor, cause the processor to receive, from the communications interface, an operational parameter of the modular HVAC cartridge and/or to transmit, to the communications interface, an operational status of the HVAC cartridge. The HVAC cartridge may include a peripheral dock having a data interface compatible with a device selected from the group consisting of a $CO_2$ sensor, a video camera, a smart phone, a lighting controller, room lights, an audio playback device, and a flat panel interface. The peripheral dock may include an electrical power connector to power the peripheral device. In some embodiments, the indoor coil is divided into two sections that may be selectively coupled in a parallel configuration to facilitate a heating or cooling mode, or in a serial configuration to facilitate a dehumidification mode.

In yet another aspect, the present disclosure is directed to a modular HVAC system. The system includes a modular HVAC cartridge, a control hub in operative communication with the modular HVAC cartridge, a temperature sensor in operative communication with the control hub, an active register in operative communication with the control hub, and a mobile device in operative communication with the control hub. In embodiments, the mobile device includes a processor and a memory including instructions executable by the processor which, when executed by the processor, cause the mobile device to transmit a temperature setpoint to the control hub and/or to receive an operational status from the control hub. In embodiments, the control hub comprises a processor and a memory including instructions executable by the processor which, when executed by the processor, cause the control hub to receive a temperature setpoint from the mobile device; receive a temperature measurement from the temperature sensor; and transmit an operational parameter to the active register based on the temperature setpoint and the temperature measurement.

In some embodiments, the control hub includes a processor and a memory including instructions executable by the processor which, when executed by the processor, cause the control hub to receive a temperature setpoint from the mobile device; receive a temperature measurement from the temperature sensor; and transmit an operational parameter to the modular HVAC cartridge based on the temperature setpoint and the temperature measurement. In some embodiments, the modular HVAC system includes a thermostat that communicates with the control hub. The memory of the may including instructions executable by the processor which, when executed by the processor, cause the control hub to receive a temperature setpoint and/or an operational parameter from the thermostat; and transmit an operational parameter to the modular HVAC cartridge based on the temperature setpoint and/or the operational parameter.

In some embodiments, the modular HVAC system includes a remote server in operative communication with the control hub. The remote server includes a processor and a memory programmed with instructions to cause the remote server to receive one or more operational parameters from the control hub; store the received operational parameters in a backup database; and transmit one or more of the stored operational parameters to the control hub. The remote server may be programmed to receive one or more operational parameters from the mobile device; and transmit one or more of the received operational parameters to the control hub.

The active register includes a communications interface, at least one fan, and a controller. The active register controller includes a processor, and a memory programmed with instructions to cause the active register to receive a fan command from the control hub; and adjust the speed of the fan in accordance with the fan command. The active register may additionally or alternatively be programmed to receive a setpoint temperature from the control hub; receive a temperature measurement from the temperature sensor; and adjust the fan speed in accordance with the setpoint temperature and the temperature measurement. In some embodiments, the active register may additionally or alternatively be programmed to transmit the fan speed to the control hub.

BRIEF DESCRIPTION OF THE DRAWINGS

Exemplary embodiments of the disclosed invention are described herein with reference to the drawings wherein.

Figure 1:
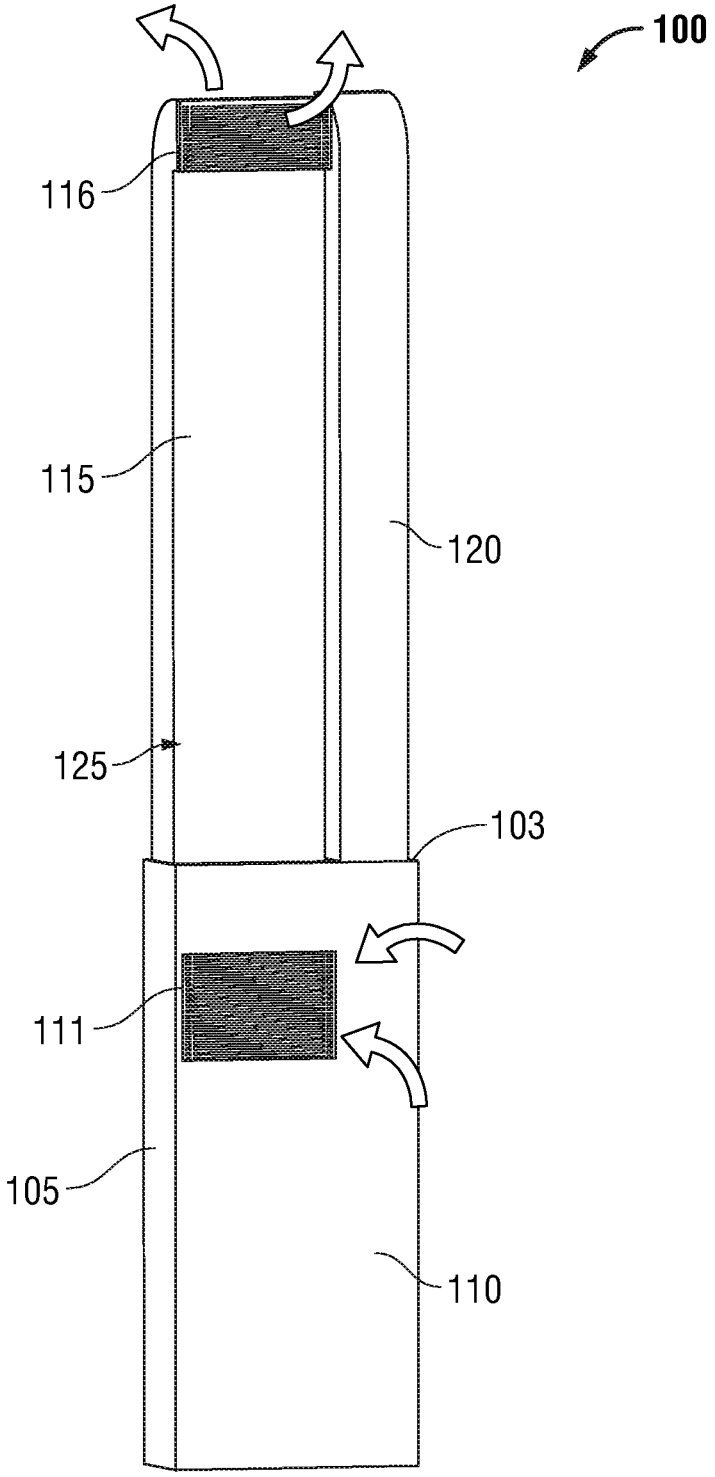
FIG. 1 is a perspective view of an exemplary embodiment of a modular HVAC unit viewed from the indoor side.

Aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings, however, the disclosed embodiments are merely examples of the disclosure, which may be embodied in various forms. Well-known functions or constructions, such as the fundamental operation of a vapor compression heat pump system, as well as repetitive matter, are not described in detail to avoid obscuring the present disclosure in unnecessary or redundant detail. Therefore, specific structural and functional details disclosed herein are not to be interpreted as limiting, but as a basis for the claims and examples for teaching one skilled in the art to variously employ the present disclosure in any appropriately-detailed structure. In this description, as well as in the drawings, like-referenced numbers represent elements which may perform the same, similar, or equivalent functions. The word "exemplary" is used herein to mean "serving as a non-limiting example, instance, or illustration." Any embodiment described herein as "exemplary" is not necessarily to be construed as preferred or advantageous over other embodiments. The word "example" may be used interchangeably with the term "exemplary."

Aspects of the present disclosure may be described herein in terms of functional block components and various processing steps. It should be appreciated that such functional blocks configured to perform the specified functions may be embodied in mechanical devices, electromechanical devices, analog circuitry, digital circuitry, and/or modules embodied in a computer. For example, the present disclosure may employ various discrete components, integrated circuit components (e.g., memory elements, processing elements such as microprocessors or microcontrollers, logic elements, look-up tables, and the like) which may carry out a variety of functions, whether independently, in cooperation with one or more other components, and/or under the control of one or more processors or other control devices. The express disclosure of a component (e.g., processor, memory, driver, interface, etc.) used in one element should not be construed to exclude the use of a similar component that may not be expressly disclosed in another element. One skilled in the art will also appreciate that, for security reasons, any element of the present disclosure may includes any of various suitable security features, such as firewalls, access codes, passwords, authentication, encryption, de-encryption, compression, decompression, and/or the like. It should be understood that the steps recited herein may be executed in any order and are not limited to the order presented. Moreover, two or more steps or actions recited herein may be performed concurrently.

Figure 2:
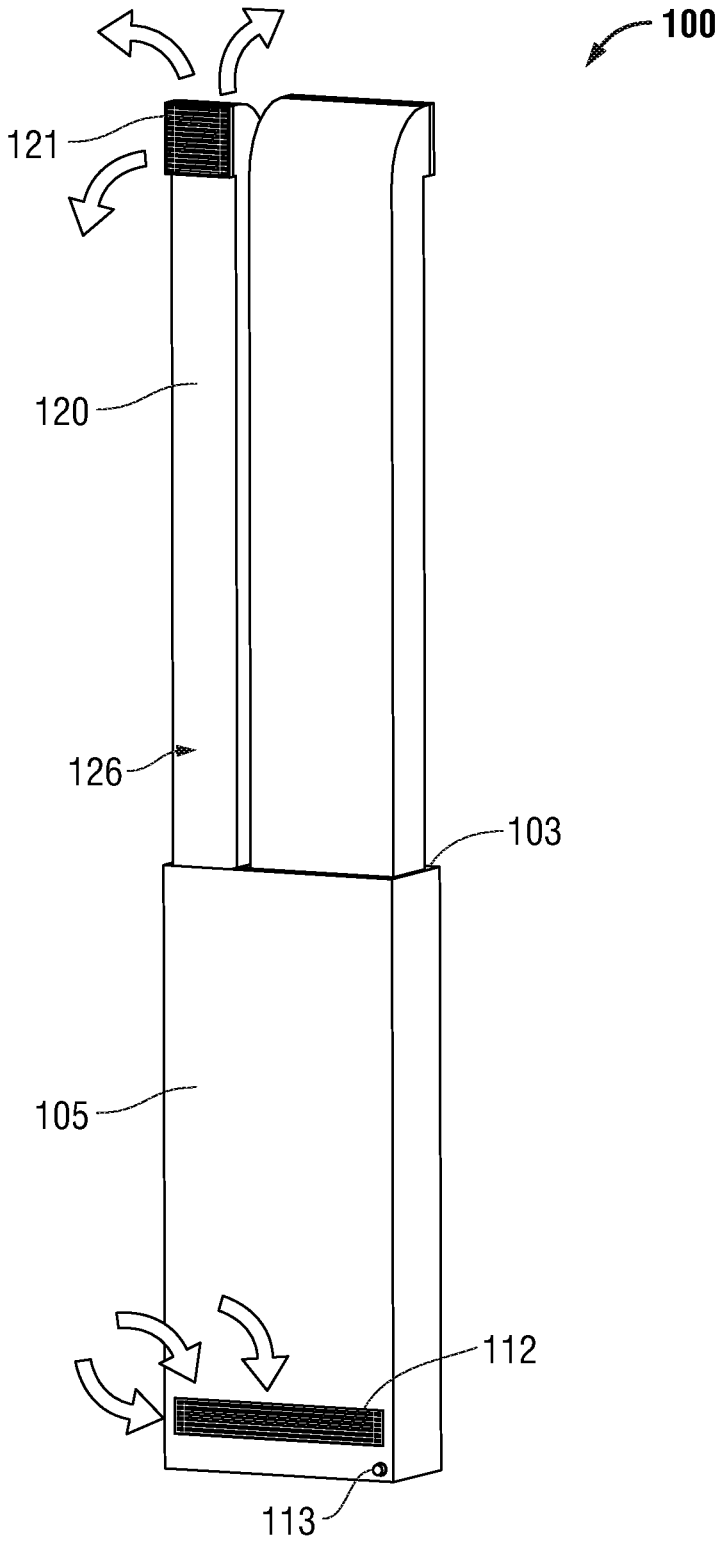
FIG. 2 is a perspective view of an exemplary embodiment of a modular HVAC unit viewed from the outdoor side.
Figure 3:
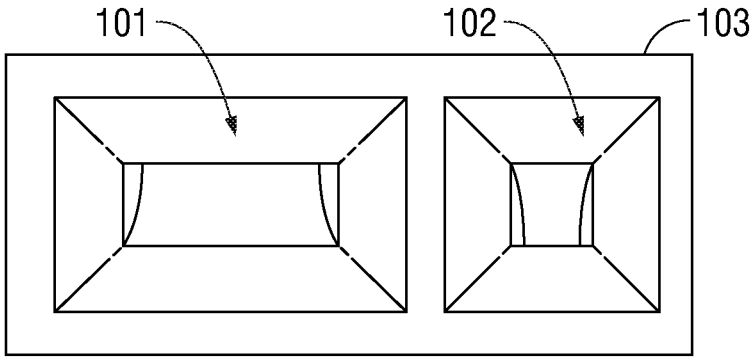
FIG. 3 is an upward-facing view of the underside of a top surface of an in-wall enclosure according to an exemplary embodiment of the present disclosure.
Figure 4A:
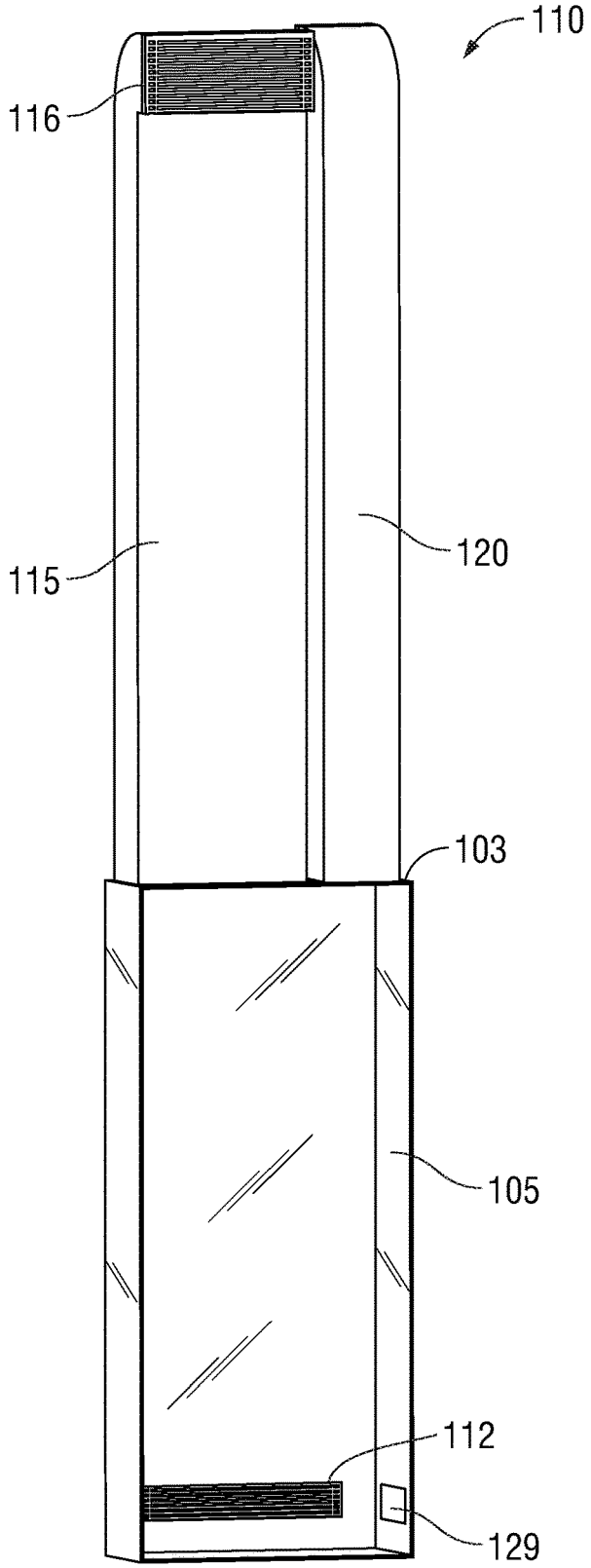
FIG. 4A is a perspective view of an exemplary embodiment of a modular HVAC unit with the cartridge unit removed as viewed from the indoor side.
Figure 4B:
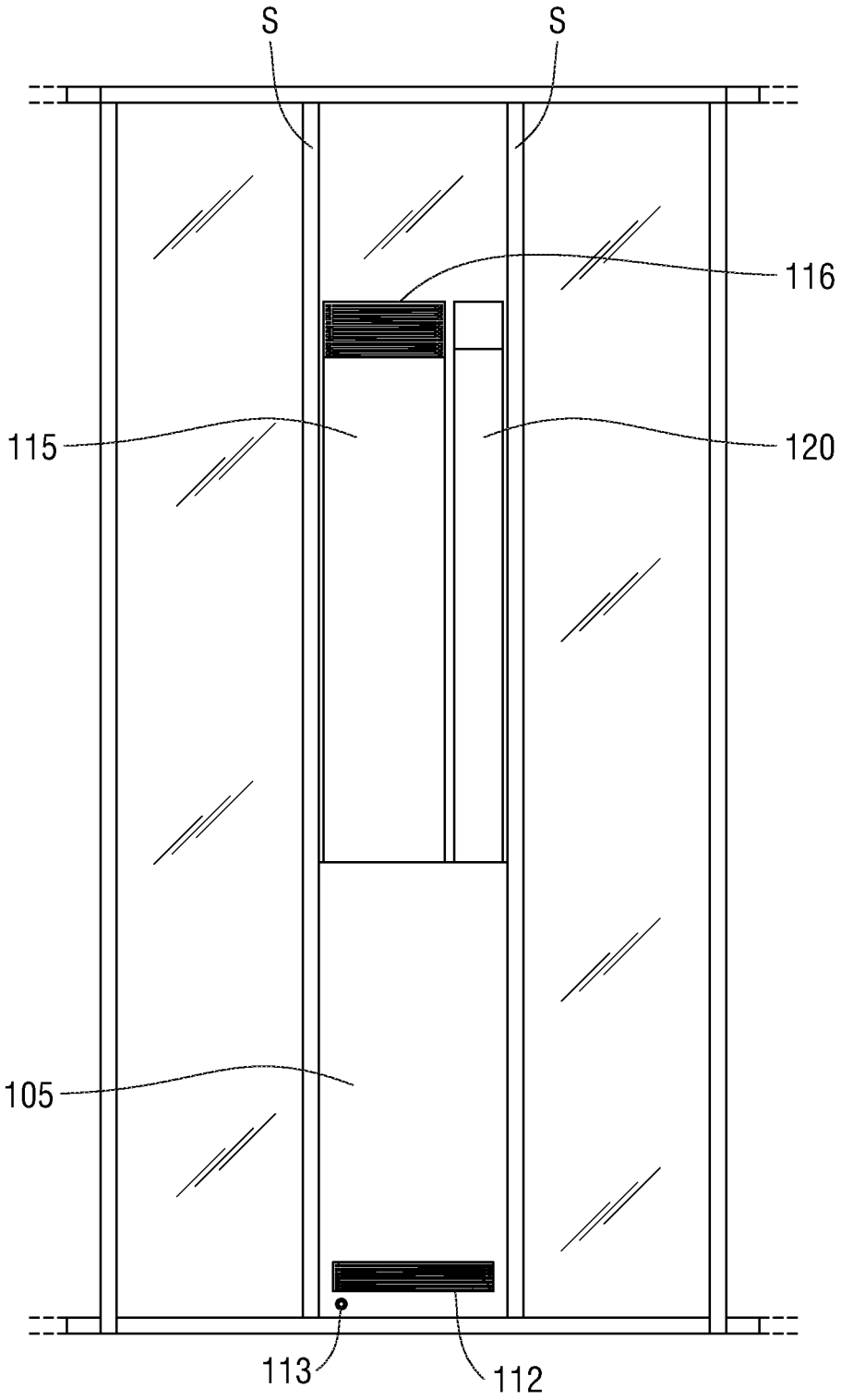
FIG. 4B is a view of exemplary embodiment of a modular HVAC unit with the cartridge unit removed mounted between two wall studs.

FIGS. 1-2 illustrate a modular HVAC unit 100 in accordance with an exemplary embodiment of the present disclosure. HVAC unit 100 is preferably dimensioned to fit within an exterior wall of a building, and includes an indoor side 125 as seen in FIG. 1 and an outdoor side 126 as seen in FIG. 2. In an embodiment, HVAC unit 100 has an overall size of about 14.5 inches wide, 5.5 inches deep, and about 7 feet high to enable HVAC unit 100 to fit neatly between two studs, the exterior wall or sheathing, and the interior wall (e.g., drywall) of a typical building, such as a residential home. HVAC unit 100 includes an in-wall enclosure 105 that is configured to operatively receive a replaceable refrigeration cartridge unit 110. As seen in FIG. 3, in-wall enclosure 105 includes a top surface 103 having an indoor duct opening 101 and an outdoor duct opening 102 defined therein, to which an indoor duct 115 and an outdoor duct 120 are respectively attached. The outdoor side 126 includes an outdoor inlet louver 112 to allow outside air to be drawn into enclosure 105. A condensate outlet port 113 enables condensate to drain from HVAC unit 100 to the outdoor environment. An upper end of indoor duct 115 includes an indoor outlet louver 116 configured to direct conditioned air into the interior of the building. An upper end of outdoor duct 120 includes an outdoor outlet louver 121 configured to exhaust air from in-wall enclosure 105 to the outdoor environment. FIG. 4A illustrates modular HVAC unit 100 with cartridge unit 110 removed. An electrical connector 129 is provided by in-wall enclosure 105 to supply electrical power to cartridge unit 110. FIG. 4B illustrates modular HVAC unit 110 with cartridge unit 110 removed installed between wall studs S of a residential building, e.g., one under construction. Advantageously, in a retro-fit application, the modular HVAC unit 100 may installed with minimal disruption to the building structure, typically less than one sheet of drywall is disturbed.

Figure 5:
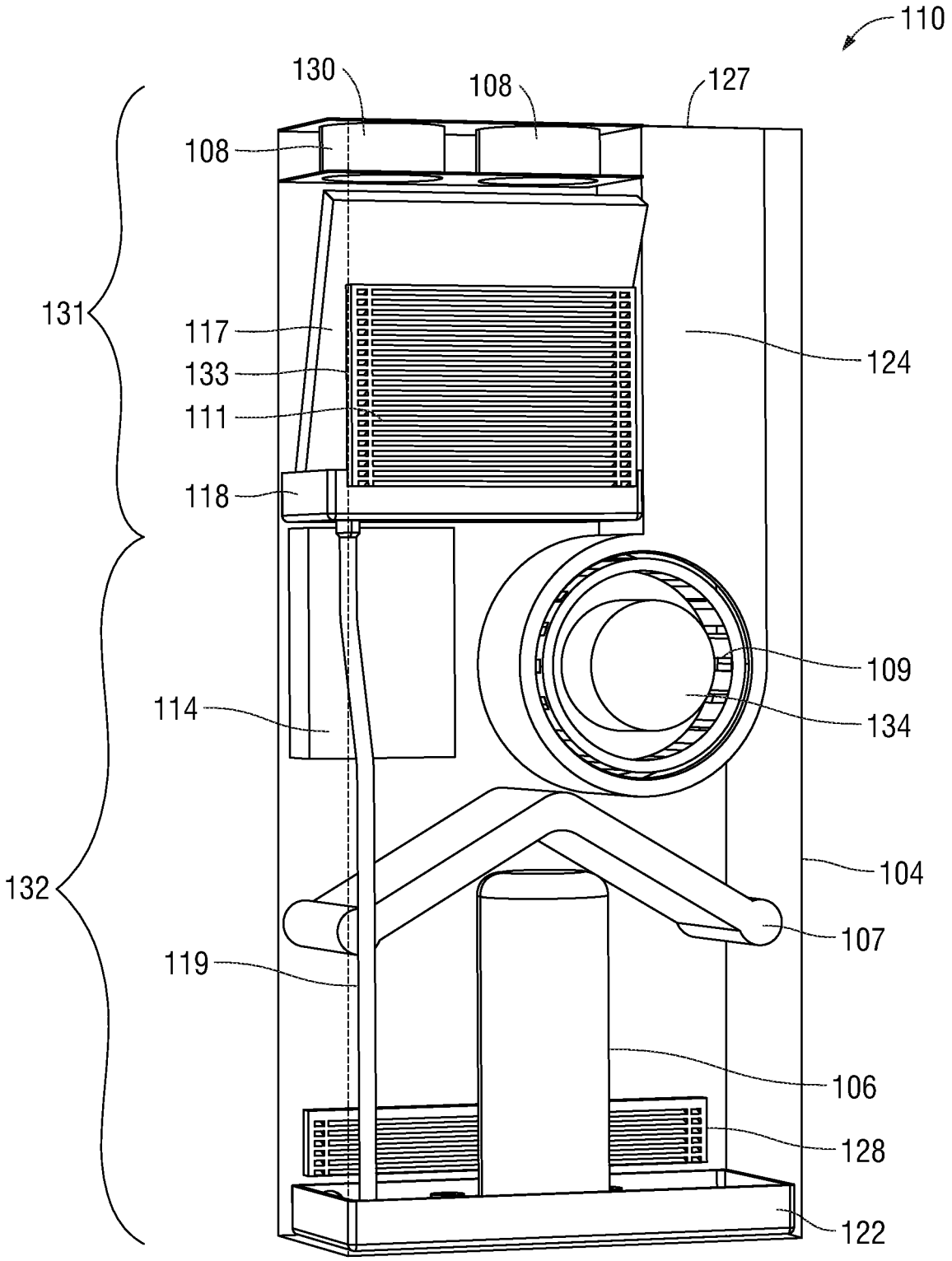
FIG. 5 is a cutaway view of an exemplary embodiment of an HVAC cartridge unit in accordance with the present disclosure viewed from the indoor side.
Figure 6:
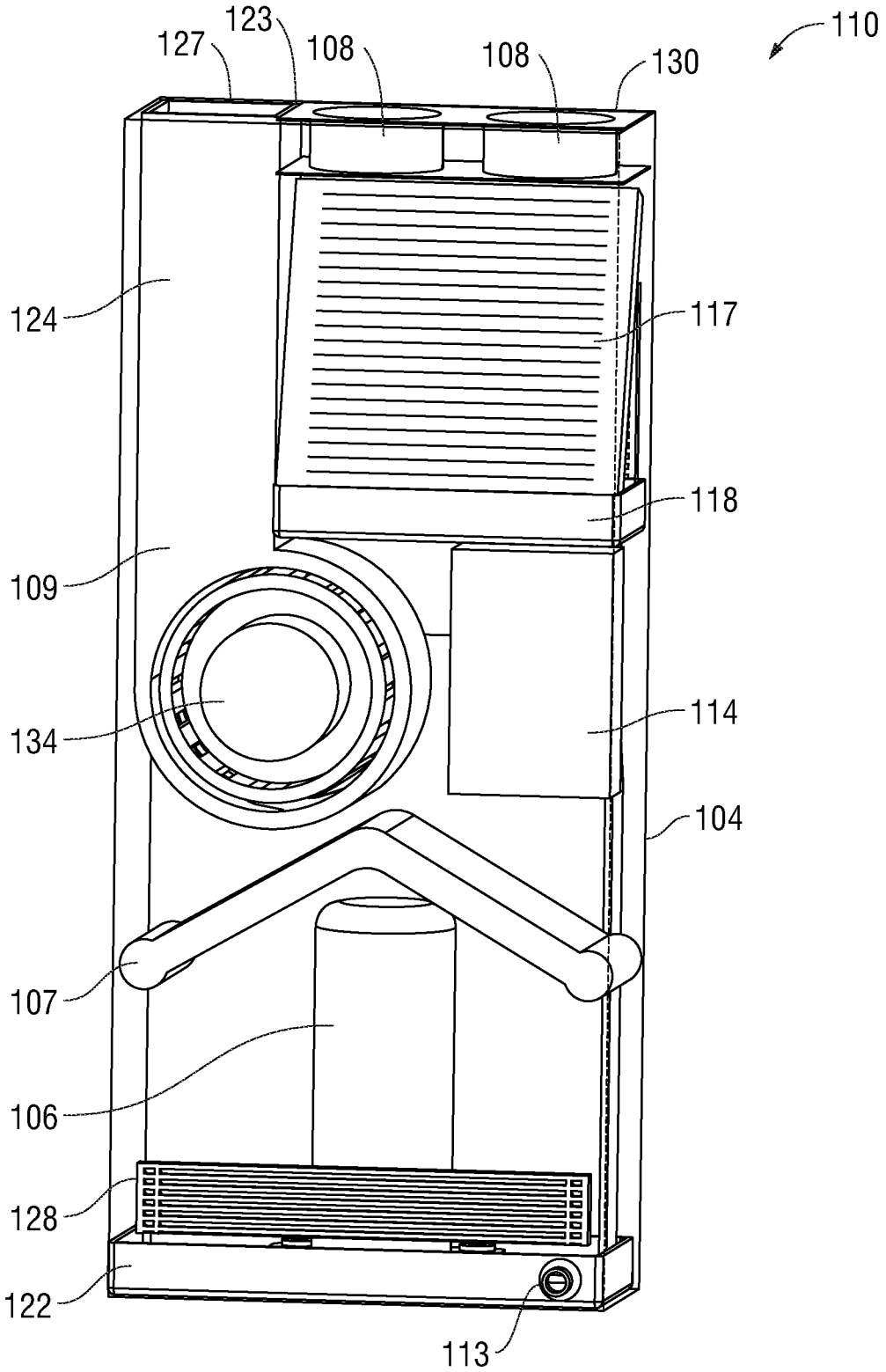
FIG. 6 is a cutaway view of an exemplary embodiment of an HVAC cartridge unit in accordance with the present disclosure viewed from the outdoor side.

With reference now to the exemplary embodiment shown in FIGS. 5 and 6, refrigeration cartridge unit 110 is a self-contained heat pump packaged in cartridge unit housing 104 that is selectively installable into in-wall enclosure 105. Cartridge unit 110 includes components typically found in both an outdoor unit and indoor unit of a split heat pump system to provide an integrated, "plug and play" HVAC installation.

An outdoor section 132 of cartridge unit 110 includes compressor 106 and an outdoor fan 109 that draws in outdoor air through an outdoor inlet filter 128 disposed on a lower portion of outdoor side 126. Outdoor fan 109 may be driven by a fixed-speed or a variable-speed motor 134. In some embodiments, outdoor fan 109 is a centrifugal blower. Outdoor inlet filter 128 is positioned to be in substantial alignment with outdoor inlet louver 112 when cartridge unit 110 is installed into in-wall enclosure 105, and aids in preventing debris and pests from entering HVAC unit 100. Outdoor coil 107 is positioned between outdoor inlet filter 128 and the intake of outdoor fan 109. The exhaust of outdoor fan 109 is coupled to outdoor fan exhaust duct 124 that terminates at an outdoor air port 127. Outdoor air port 127 is configured to be in substantial alignment with outdoor duct opening 102 of in-wall enclosure 105 when cartridge unit 110 is installed into in-wall enclosure 105, therefore enabling air to flow from cartridge unit 110 upwards through outdoor duct 120 to the outdoor environment via outdoor outlet louver 121. An outdoor condensate pan 122 is positioned beneath outdoor coil 107 to collect condensate (e.g., water) that may precipitate from outdoor coil 107. Condensate pan 122 is pitched to permit collected condensate to drain from condensate pan 122 to the outdoors via condensate outlet 113.

Cartridge unit 110 includes an indoor section 131 having an indoor inlet louver 111, an indoor inlet filter 133, an indoor coil 117, an indoor condensate pan 118, and one or more indoor fans 108. Indoor inlet filter 133 aids in preventing dust and allergens from entering HVAC unit 100. In embodiments, indoor inlet filter 133 may include a HEPA filter, an electrostatic filter, and/or an air purifier that utilizes ultraviolet light to disinfect indoor air. The one or more indoor fans 108 may be driven by fixed-speed or variable-speed motors, and may be operated in tandem, or individually (e.g., in a staged configuration). Indoor air port 130 is configured to be in substantial alignment with indoor duct opening 101 of in-wall enclosure 105 when cartridge unit 110 is installed into in-wall enclosure 105, therefore enabling conditioned air to flow from cartridge unit 110 upwards through indoor duct 115 and into the conditioned space via indoor outlet louver 116. Indoor condensate pan 118 is positioned beneath indoor coil 117 to collect condensate (e.g., water) that may precipitate from indoor coil 117. Indoor condensate pan 118 is pitched to enable condensate to drain into a drain pipe 119 that empties into outdoor condensate pan 122, and from outdoor condensate pan 122 to the outdoors via condensate outlet 113 as described above.

Cartridge unit 110 includes control module 114 that adjusts the operation of indoor fan(s) 108, outdoor fan 109 and compressor 106 as described herein. In some embodiments, indoor coil 117 is divided into two sections that may be selectively coupled in a parallel or serial configuration, which enables heat pump 100 to provide a heating or cooling mode while in a parallel configuration, and a dehumidification mode while in a serial configuration. A heat pump that provides heating, cooling, and/or dehumidification modes is disclosed in U.S. patent application Ser. No. 15/485,439, filed Apr. 12, 2017, entitled "MULTI-FUNCTIONAL HEAT PUMP APPARATUS" which is assigned to the assignee of the present application and is hereby incorporated by reference herein for all purposes.

During use, the one or more indoor fans 108 draw indoor air through indoor inlet louver 111 and indoor inlet filter 133, through indoor coil 117 to cool the indoor air in cooling mode or to heat indoor air in heating mode, and out through indoor air port 130. Concurrently, outdoor air is drawn in by outdoor fan 109 though outdoor inlet louver 112 and outdoor inlet filter 128, passes through outdoor coil 107 to exchange heat between indoor coil 107 and the outdoor air, and exhausts though exhaust duct 127 and outdoor duct 120. In some embodiments, cartridge unit 110 includes a ventilation damper (not explicitly shown) that enables fresh outdoor air to be drawn into the indoor space and/or stale indoor air to be exhausted to the outdoors. In some embodiments, cartridge unit 110 includes a heat recovery ventilator (HRV) or an energy recovery ventilator (ERV) (not explicitly shown) to provide ventilation while limiting thermal losses and/or undesirable humidity changes in the indoor space.

Figure 7:
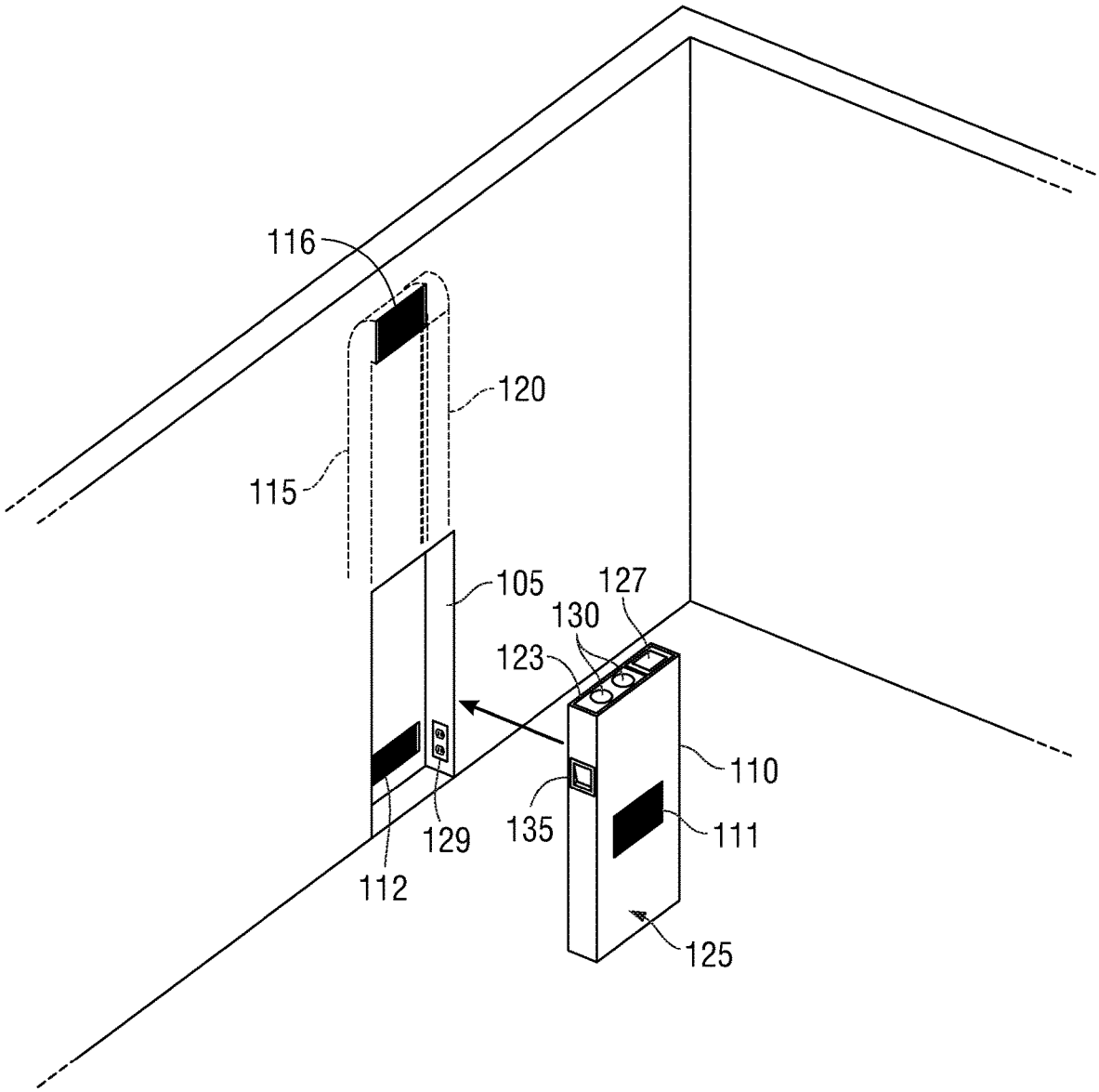
FIG. 7 is a view of an HVAC cartridge unit just prior to installation into a modular HVAC enclosure.

FIG. 7 illustrates a cartridge unit 110 as it is inserted into an installed in-wall enclosure 105. Electrical power is provided to cartridge unit 110 by electrical connector 129 provided by in-wall enclosure 105. In some embodiments, electrical connector 129 can be a standard 120VAC or 240VAC outlet into which a pigtail line cord (not explicitly shown) from cartridge unit 110 is plugged. In some embodiments, electrical connector 129 can include a quick-connect mechanism that engages with a mating connector provided on cartridge unit 110 as cartridge unit 110 is positioned into in-wall enclosure 105. Cartridge unit 110 includes a handle 135 on either side to allow cartridge unit 110 to be moved about in a safe and convenient manner. A gasket 123 effectuates a seal between outdoor air port 127 and indoor air port 130 with corresponding outdoor duct opening 102 and indoor duct opening 101, respectively. Advantageously, cartridge unit 110 may be readily removed for maintenance, service, to swap out an existing cartridge unit 110 for another cartridge unit 110 having a different heating/cooling capacity, and/or to upgrade to a cartridge unit 110 having newer features, for example.

Figure 8:
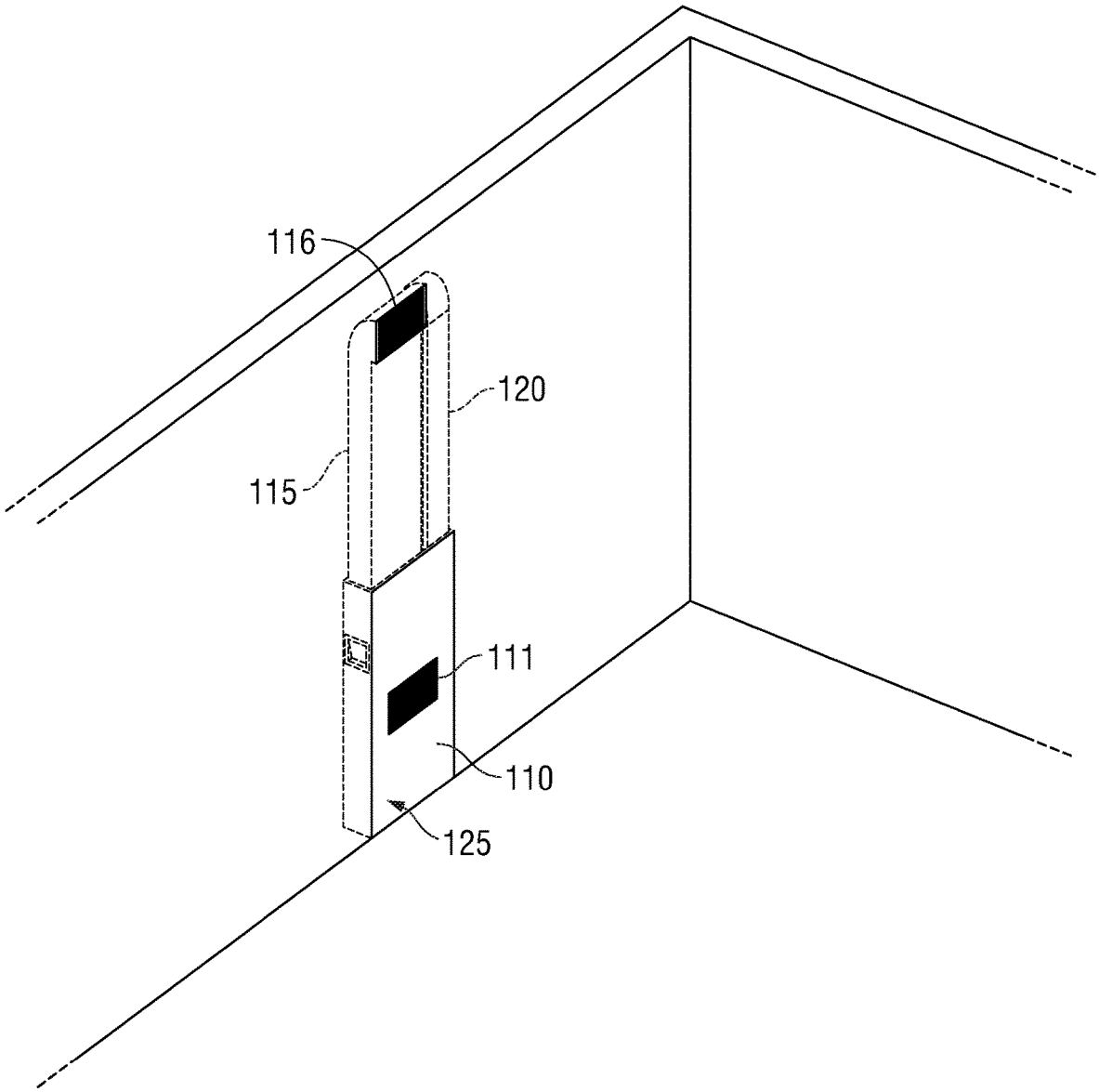
FIG. 8 is a view of a cartridge unit installed into a modular HVAC unit.

When fully inserted into in-wall enclosure 105, cartridge unit 110 lies substantially flush with the adjacent wall (FIG. 8). As will be appreciated, indoor duct 115 and outdoor duct 120 are hidden behind the interior wall, with only the indoor outlet louver 116 and the indoor side 125 of cartridge unit 110 remaining visible. Indoor side 125 of cartridge unit 110 may be formed from a readily paintable material, such as a primer coat, and/or may include clips or a similar mechanism to enable cartridge unit 110 to accept a finish similar or identical to the room in which it is installed, e.g., house paint, wallpaper, paneling, wainscoting, and so forth.

Figure 9:
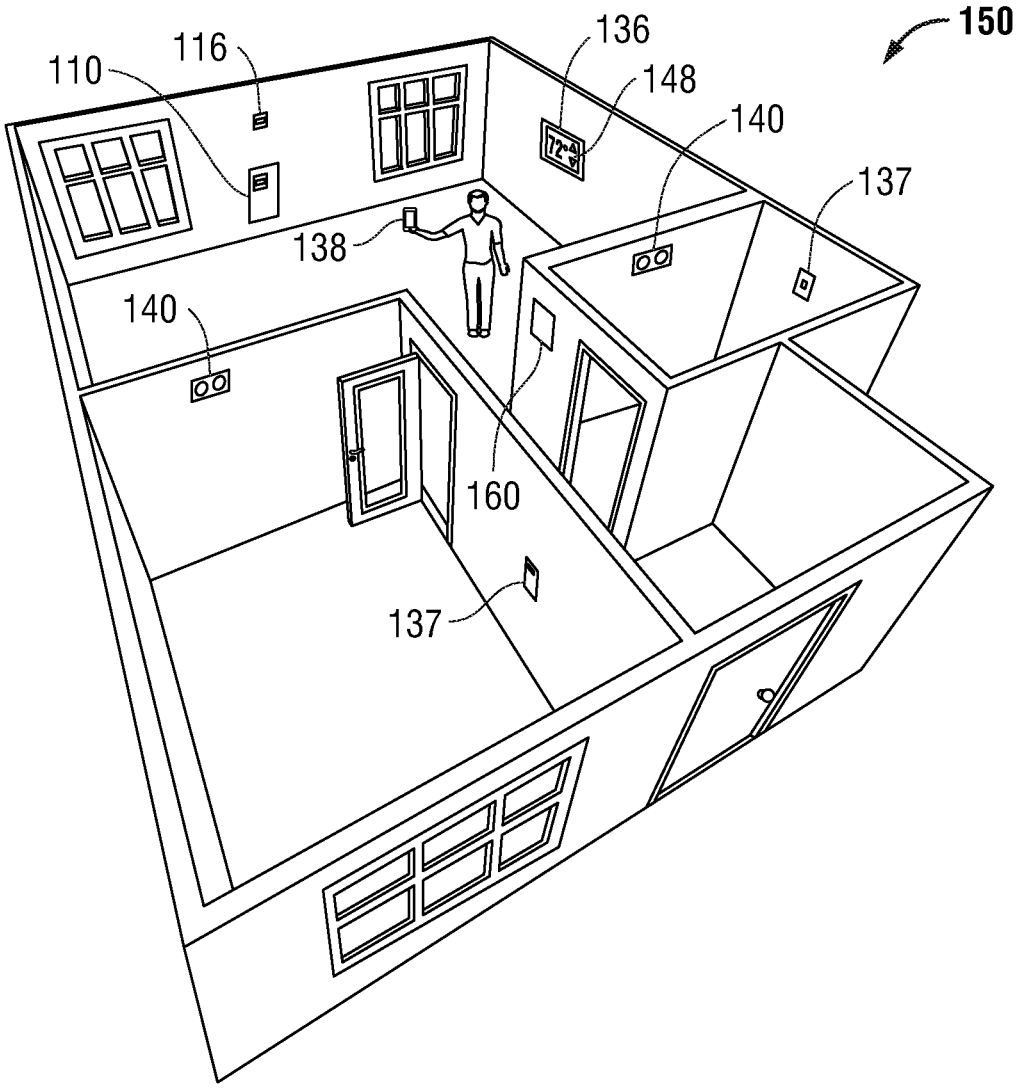
FIG. 9 is a pictorial diagram of a modular HVAC system in accordance with an exemplary embodiment of the present disclosure.
Figure 10:
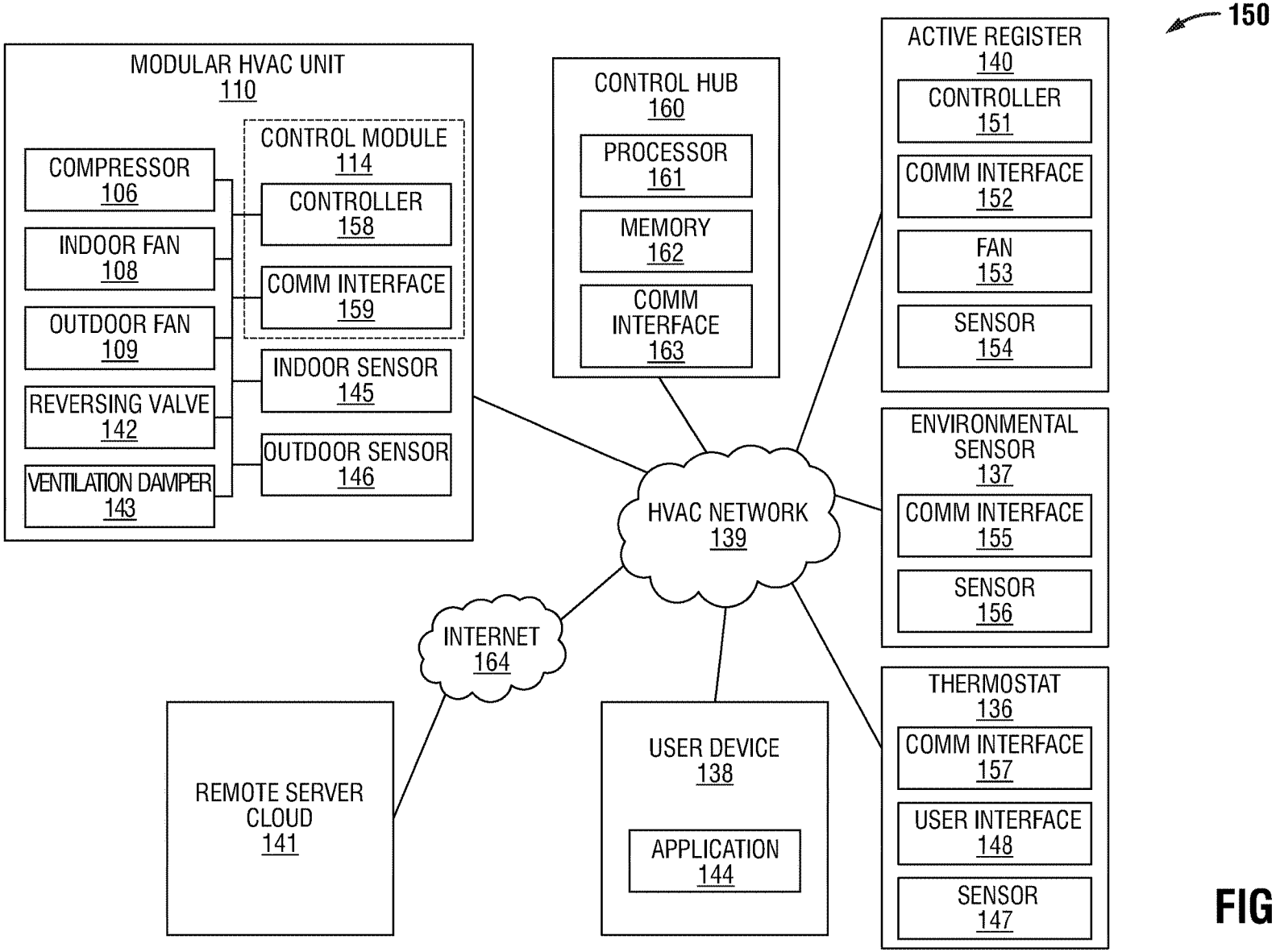
FIG. 10 is a block diagram of a modular HVAC system in accordance with an exemplary embodiment of the present disclosure.
Figure 11A:
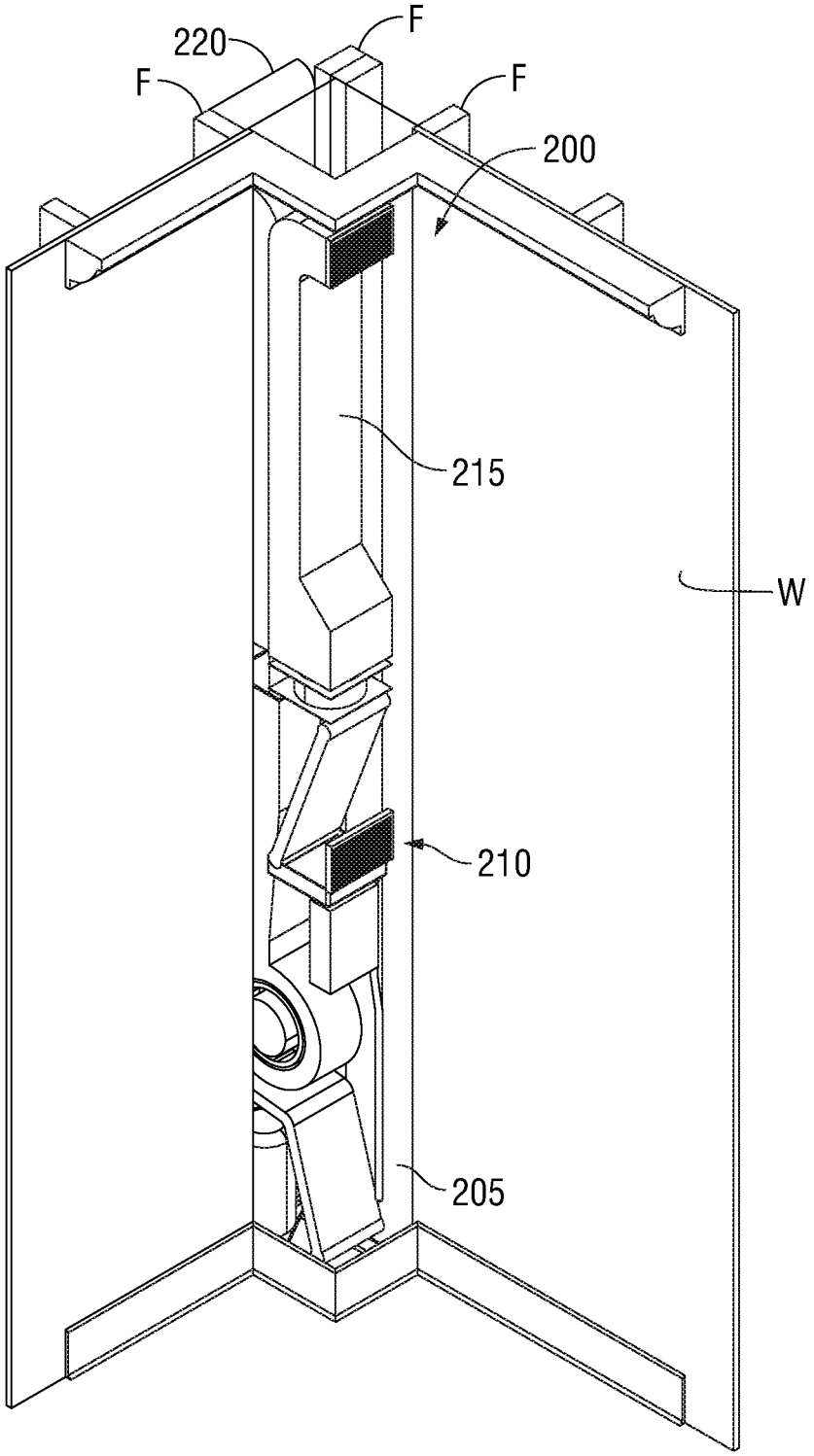
FIGS. 11A-D are views of an exemplary embodiment of a modular HVAC unit in accordance with the present disclosure that is configured for installation in a corner of a room.
Figure 11B:
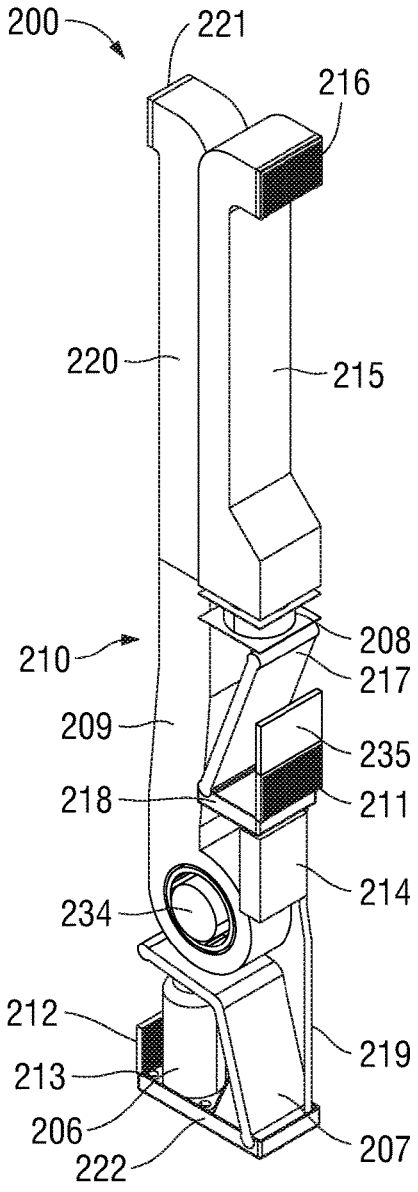
Figure 11C:
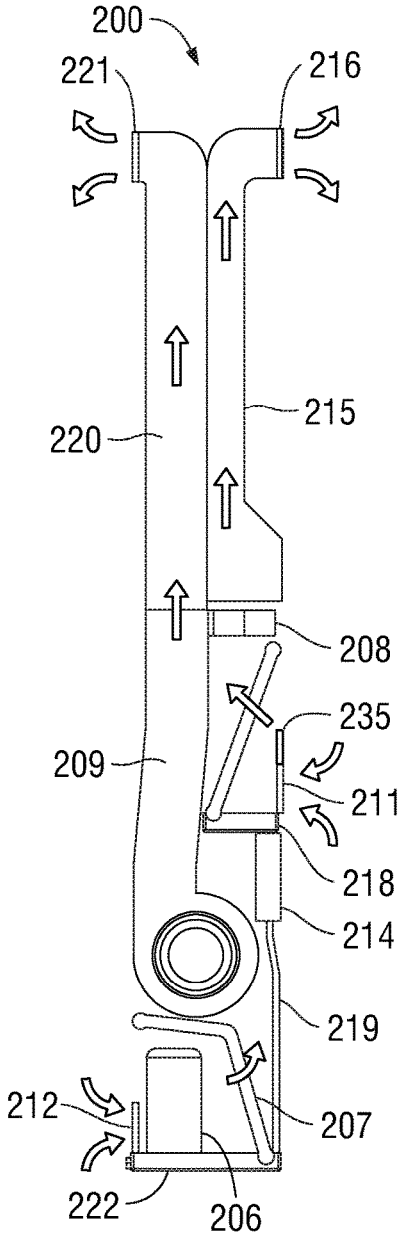
Figure 11D:
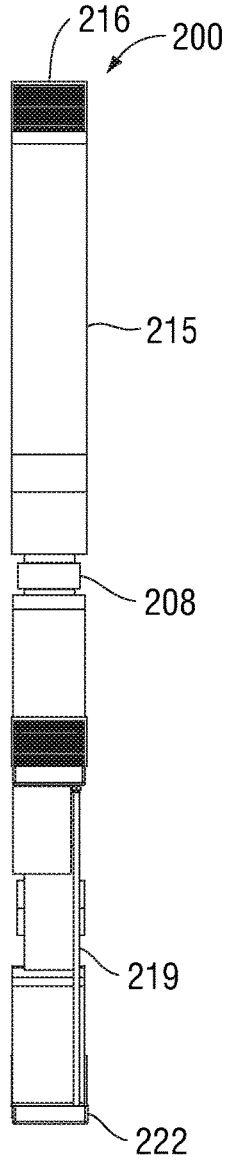

FIGS. 9-10 illustrate an embodiment of a modular HVAC system 150 in accordance with an exemplary embodiment of the present disclosure. Modular HVAC system 150 includes at least one modular HVAC unit 110 installed in an outer wall of a home, and a control hub 160 that coordinates the operation of each component of HVAC system 150 as described herein. In some embodiments, control hub 160 may be included within controller 114 of modular HVAC unit 110. In embodiments having a plurality of modular HVAC units, one such control hub 160 included within controller 114 is designated as a primary controller, while the other controllers 160 may be designated as a failover controller. A room in which a modular HVAC unit 110 is installed is referred to herein as a primary room. A room in which no modular HVAC unit 110 is installed is referred to herein as a secondary room.

A mobile device 138 in operative communication with control hub 160 may be used by a user to adjust the operational parameters of modular HVAC system 150. Non-limiting examples of operational parameters include system on/off, temperature setpoint, humidity setpoint, scheduling, indoor fan speed, outdoor fan speed, compressor speed, ventilation damper position, operational mode, and so forth. Operational mode can include heating mode, cooling mode, dehumidification mode, ventilation mode, and/or an automatic mode whereby operational mode is determined from indoor conditions, outdoor conditions, weather forecast data, time-of-day, and/or time-of-year (seasonal) data. In an embodiment, mobile device 138 can be a smart phone, tablet computer, notebook computer and/or a desktop computer. User device 138 includes application software 144 that facilitates interaction between the user and control hub 160.

HVAC system 150 includes a thermostat 136 positioned within the home. Thermostat 136 includes a communications interface 157, a sensor 147 configured to measure an environmental parameter within the home such as temperature and/or humidity, and a user interface 148 that facilitates user interaction between the user and thermostat 136 to enable the user to adjust operational parameters of modular HVAC system 150 as described above. Communications interface 157 is configured for operative communication with control hub 160 to enable thermostat 136 to exchange operational parameters and system status with modular HVAC system 150. In embodiments where HVAC system 150 includes a plurality of modular HVAC units 110, an equal number of thermostats 136 may be provided. In these embodiments, each thermostat 136 may be paired with a corresponding modular HVAC unit 110.

HVAC system 150 includes at least one room sensor 137 positioned within the home. Room sensor 137 includes a communications interface 155, and a sensor element 156 configured to measure an environmental parameter within the home such as temperature and/or humidity. Sensor 156 senses an environmental condition in the vicinity of room sensor 137, e.g., temperature and/or humidity, and communicated via HVAC network 139 to, for example, control hub 160 and/or modular HVAC unit 110 by communications interface 155. A room sensor 137 may be installed in a secondary room to enable modular control hub 160 to determine whether conditioned air is being effectively distributed throughout the home.

Control hub 160 is in operative communication with at least one active register 140 which circulates conditioned air between rooms to achieve consistent environmental conditions throughout the home. Active register 140 is configured for mounting though an interior wall of the home and includes a controller 151, a communications interface 152, an environmental sensor 154 and at least one fan 153 that selectively moves air between the interior spaces or room separated by the wall through which active register 140 is mounted. In embodiments, active register 140 can selectively move air in either direction, which may be achieved by, for example, reversing the direction of rotation of fan 153, through the use of variable pitch fan blades, and/or the use of separate fans 153 for each direction of airflow.

Active register 140 may be associated with a modular HVAC unit 100 installed in a primary room and a room sensor 137 positioned within a secondary room. During use, the associated room sensor 137 communicates the environmental conditions within the secondary room served by active register 140 to control hub 160. Control hub 160 compares the environmental conditions within the secondary room to the setpoint of the associated modular HVAC unit 100 (e.g., the setpoints for the primary room) to determine whether an imbalance exists (e.g., the secondary room is too hot or too cold compared to the primary room). Control hub 160 then causes active register 140 activate fan 153 to move air in the appropriate direction to balance the environmental condition within the secondary room toward the setpoint.

In an embodiment, active register 140 may operate in a semi-autonomous mode whereby an associated room sensor 137 communicates environmental conditions of the secondary room to active register 140. An environmental sensor 149 included in active register 140 senses the environmental conditions of the primary room. Controller 151 compares the environmental conditions of the primary room to the environmental conditions of the secondary room and activates fan 153 to move air in the appropriate direction to adjust the environmental condition within the secondary room toward the environmental conditions of the primary room, or vice versa.

With continued reference to FIG. 9, the various components of modular HVAC system 150 (e.g., modular HVAC unit 110, active register 140, room sensor 137, thermostat 136, user device 138, control hub 160) include a communications interface (e.g., communications interface 159 for modular HVAC unit 110, communications interface 152 active register 140, communications interface 155 for room sensor 137, communications interface 157 for thermostat 136, and communications interface 163 for control hub 160) configured to enable said modules to communicate between and among themselves via HVAC network 139. In an exemplary embodiment, HVAC network 139 is a wireless network that operates in accordance the IEEE 802.11 set of standards known as "WiFi." Additionally or alternatively, HVAC network 139 operates in accordance with the IEEE 802.15.4 set of wireless communications standards and extensions thereof, such as without limitation Z-Wave®, Zigbee®, and/or Bluetooth®. In some embodiments, HVAC network 139 additionally operates in accordance with one or more wired communications standards such as, without, limitation, Ethernet, RS-485, and so forth.

Module 114 of modular HVAC unit 110 includes a controller 158 and a communications interface 159. Controller 158 is in operative communication with compressor 106, indoor fan 108, outdoor fan 109, reversing valve 142, and ventilation damper 143 to adjust the operation thereof. Controller 158 is in operative communication with indoor sensor 145 and outdoor sensor 146 to sense an environmental condition, e.g., temperature and/or humidity, in the interior conditioned space and/or outdoor environment, respectively.

Active register 140 includes a controller 151, and a communications interface 152. Communications interface 152 receives fan control commands from, for example, control hub 160, which are communicated to controller 151. Controller 151 is in operative communication with communications interface 152 and fan 153 to adjust the speed and/or direction of fan 153, and with sensor 154 to sense an environmental condition in the vicinity of active register, e.g., temperature and/or humidity.

Thermostat 136 includes a communications interface 155, a user interface 148, and a sensor 147. User interface 148 enables a user to enter settings, such as temperature setpoint, operating mode, schedule, and so forth, and communicates the user settings via HVAC network 139 to control hub 160 and/or modular HVAC unit 110. Thermostat 136 may receive status, operational, informational, and diagnostic information via communications interface 157 which may be displayed on user interface 148. Thermostat 136 includes an environmental sensor 147 configured to sense an environmental condition in the vicinity of thermostat 136, e.g., temperature and/or humidity. As will be appreciated by one of ordinary skill, thermostat 136 compares the sensed environmental condition, such as temperature, to a setpoint, and communicates a signal to modular HVAC unit 110, control hub 160, or other suitable device to activate or deactivate modular HVAC unit 110 to maintain the conditioned space at the desired setpoint. Thermostat 136 may additionally or alternatively communicate the sensed environmental parameter to modular HVAC unit 110, control hub 160, or other device in modular HVAC system 150. A software application 144 ("app") executing on a user's user device 138 enables a user to interact with modular HVAC system 150 to set system operating parameters and to obtain system status.

Modular HVAC system 150 communicates with remote server cloud 141 that is accessible via the public internet 164. A user can establish a user account at remote server cloud 141 and associate the account with modular HVAC system 150. A user account may be established and accessed by a website portal provided by remote cloud server 141 and/or using software application 144. Modular HVAC system 150 communicates user setting and system status to remote server cloud 141 for backup and to act as a gateway between user device 138 and HVAC network when user device 138 is outside the range of HVAC network 139. In this scenario, user device 138 communicates with remote server cloud 141 via the public internet 164 using cellular or local WiFi services. Remote server cloud 141, in turn, relays user settings and status information between modular HVAC system 150 and user device 138. In some embodiments, a user may enter settings and/or receive status information using a web portal provided by remote server cloud 141.

FIGS. 11A-D illustrate a modular HVAC unit 200 in accordance with another exemplary embodiment of the present disclosure. In contrast to modular HVAC unit 100 that is installed into a wall of a building, modular HVAC unit 200 is installed in a corner location of a room, such that HVAC unit 200 fits neatly within the corner framing "F" of the building. Modular HVAC unit 200 includes an in-wall enclosure 205 that is configured to operatively receive a replaceable refrigeration cartridge unit 210. In-wall enclosure 205 includes an indoor duct 215 and an outdoor duct 220. A compressor 206 circulates refrigerant through outdoor coil 207 and indoor coil 217 to effectuate a vapor-compression refrigeration cycle. An outdoor inlet louver 212 is configured to allow outside air to be drawn into enclosure 205 by outdoor fan 209, and through outdoor coil 207 to exchange heat between the outdoor air and outdoor coil 207. As will be appreciated by the skilled artisan, in cooling mode, heat is moved out of outdoor coil 207 to the outdoor air flowing therethough, while in heating mode, heat is moved from outdoor air into outdoor coil 207. Outdoor air continues upwards through outdoor duct 220, and exhausted through outdoor outlet louver 221. Outdoor fan 209 may be driven by a fixed-speed or a variable-speed motor 234. In some embodiments, outdoor fan 209 is a centrifugal blower.

An indoor fan 208 draws indoor air through indoor inlet louver 211, which passes through indoor coil 217, through indoor fan 208, up through indoor duct 215, and directed into the indoor conditioned space though indoor outlet duct 216.

An indoor condensate pan 218 is positioned beneath indoor coil 217 and an outdoor condensate pan 222 is positioned under outdoor coil 207. Condensate that is collected in indoor condensate pan 218 flows through drain pipe 219 to outdoor condensate pan 222. Condensate collected in outdoor condensate pan 222 drains to the outdoors through condensate outlet 213.

Modular HVAC unit 200 includes control module 214 that adjusts the operation of indoor fan(s) 208, outdoor fan 209 and compressor 206 as described herein. Modular HVAC unit 200 includes a peripheral dock 235 that enables a smart home appliance to be connected to modular HVAC unit 200. Examples of a smart home appliance include a $CO_2$ sensor, a surveillance or baby monitor camera, room lights, an audio playback device that can includes a speaker, a flat panel interface for a smart home control system, and other small appliances. A smart appliance may be connected to modular HVAC unit 200 via a physical electrical connection and/or by a wireless connection. A charging connection, such as a powered USB port, may be provided in some embodiments. A connected smart appliance can be added to the controlled or managed through user account at remote server cloud 141 and/or software application 144, and may be manually or automatically associated with modular HVAC unit 200

ASPECTS

It is noted that any of aspects 1-23 may be combined with each other in any suitable combination.

Aspect 1. An in-wall enclosure for mounting a modular HVAC cartridge within a space defined by an exterior sheathing of a building, a first vertical stud, and a second vertical stud, comprising an indoor duct opening and an outdoor duct opening defined therein; an outdoor air inlet defined therein; and a front opening exposing a cavity configured to operatively receive a modular HVAC cartridge.

Aspect 2. The in-wall enclosure in accordance with aspect 1, further comprising an indoor duct extending from the indoor duct opening to an indoor duct outlet; and an outdoor duct extending from the outdoor duct opening to an outdoor duct outlet.

Aspect 3. The in-wall enclosure in accordance with aspect 1 or 2, further comprising a condensate outlet port.

Aspect 4. The in-wall enclosure in accordance with any of aspects 1-3, further comprising an electrical connector disposed in the cavity.

Aspect 5. The in-wall enclosure in accordance with any of aspects 1-4, wherein the electrical connector is positioned to electrically engage a mating connector provided on the modular HVAC cartridge when the modular HVAC cartridge is positioned in the in-wall enclosure.

Aspect 6. A modular HVAC cartridge, comprising a housing having at least a rear side, a top side, and a front side, the housing dimensioned to mate with the cavity of an in-wall enclosure; an indoor air port defined in the housing and configured to mate with the indoor duct of an in-wall enclosure; an outdoor air port defined in the housing and configured to mate with the outdoor duct of an in-wall enclosure; an indoor air inlet defined in the housing; an outdoor air inlet defined in the housing; an indoor coil disposed between the indoor air inlet and the indoor air port; an indoor fan for moving indoor air from the indoor air inlet to the indoor air port; an outdoor coil disposed between the outdoor air inlet and the outdoor air port; an outdoor fan for moving outdoor air from the outdoor air inlet to the outdoor air port; and a compressor in fluid communication with the indoor coil and the outdoor coil for performing a vapor-compression cycle.

Aspect 7. The modular HVAC cartridge in accordance with aspect 6, wherein the modular HVAC cartridge further comprises an indoor condensate pan positioned beneath the indoor coil; and an outdoor condensate pan positioned beneath the outdoor coil.

Aspect 8. The modular HVAC cartridge in accordance with aspect 6 or 7, further comprising a drain pipe having an upper end and a lower end, wherein the upper end is in fluid communication with the indoor condensate pan, and wherein the lower end is in fluid communication with the outdoor condensate pan.

Aspect 9. The modular HVAC cartridge in accordance with any of aspects 6-8, wherein the modular HVAC cartridge further comprises a control module, comprising a controller including a processor and a memory including instructions executable by the processor which, when executed by the processor, cause the processor to adjust the operation of the indoor fan, the outdoor fan, and/or the compressor; and a communications interface.

Aspect 10. The modular HVAC cartridge in accordance with any of aspects 6-9, wherein the memory further includes instructions executable by the processor which, when executed by the processor, cause the processor to receive, from the communications interface, an operational parameter of the modular HVAC unit and/or to transmit, to the communications interface, an operational status of the HVAC unit.

Aspect 11. The modular HVAC cartridge in accordance with any of aspects 6-10, further comprising a peripheral dock having a data interface compatible with a device selected from the group consisting of a $CO_2$ sensor, a video camera, a smart phone, a lighting controller, room lights, an audio playback device, and a flat panel interface.

Aspect 12. The modular HVAC cartridge in accordance with any of aspects 6-11, wherein the peripheral dock includes an electrical power connector.

Aspect 13. The modular HVAC cartridge in accordance with any of aspects 6-12, wherein the indoor coil is divided into two sections that may be selectively coupled in a parallel configuration to facilitate a heating or cooling mode, or in a serial configuration to facilitate a dehumidification mode.

Aspect 14. A modular HVAC system, comprising a modular HVAC cartridge; a control hub in operative communication with the modular HVAC unit; a temperature sensor in operative communication with the control hub; an active register in operative communication with the control hub; and a mobile device in operative communication with the control hub.

Aspect 15. The modular HVAC system in accordance with aspect 14, wherein the mobile device comprises a processor and a memory including instructions executable by the processor which, when executed by the processor, cause the mobile device to transmit a temperature setpoint to the control hub and/or to receive an operational status from the control hub.

Aspect 16. The modular HVAC system in accordance with aspect 14 or 15, wherein the control hub comprises a processor 161 and a memory 162 including instructions executable by the processor which, when executed by the processor, cause the control hub to receive a temperature setpoint from the mobile device; receive a temperature measurement from the temperature sensor; and transmit an operational parameter to the active register based on the temperature setpoint and the temperature measurement.

Aspect 17. The modular HVAC system in accordance with any of aspects 14-16, wherein the control hub comprises a processor and a memory including instructions executable by the processor which, when executed by the processor, cause the control hub to receive a temperature setpoint from the mobile device; receive a temperature measurement from the temperature sensor; and transmit an operational parameter to the modular HVAC cartridge based on the temperature setpoint and the temperature measurement.

Aspect 18. The modular HVAC system in accordance with any of aspects 14-17, further comprising a thermostat in operative communication with the control hub.

Aspect 19. The modular HVAC system in accordance with any of aspects 14-18, wherein the control hub comprises a processor and a memory including instructions executable by the processor which, when executed by the processor, cause the control hub to receive a temperature setpoint and/or an operational parameter from the thermostat; and transmit an operational parameter to the modular HVAC cartridge based on the temperature setpoint and/or the operational parameter.

Aspect 20. The modular HVAC system in accordance with any of aspects 14-19, further comprising a remote server in operative communication with the control hub, the remote server comprising a processor; and a memory including instructions executable by the processor which, when executed by the processor, cause the remote server to receive one or more operational parameters from the control hub; store the received operational parameters in a backup database; and transmit one or more of the stored operational parameters to the control hub.

Aspect 21. The modular HVAC system in accordance with any of aspects 14-20, further comprising a remote server in operative communication with the control hub, the remote server comprising a processor; and sa memory including instructions executable by the processor which, when executed by the processor, cause the remote server to receive one or more operational parameters from the mobile device; and transmit one or more of the received operational parameters to the control hub.

Aspect 22. The modular HVAC system in accordance with any of aspects 14-21, wherein the active register comprises a communications interface; a fan; and a controller comprising a processor, and a memory including instructions executable by the processor which, when executed by the processor, cause the active register to receive a fan command from the control hub and adjust the speed of the fan in accordance with the fan command.

Aspect 23. The modular HVAC system in accordance with any of aspects 14-22, wherein the active register comprises a communications interface; a fan; and a controller comprising a processor, and a memory including instructions executable by the processor which, when executed by the processor, cause the active register to receive a setpoint temperature from the control hub; receive a temperature measurement from the temperature sensor; and adjust the fan speed in accordance with the setpoint temperature and the temperature measurement.

Aspect 24. The modular HVAC system in accordance with any of aspects 14-23, wherein the memory of the active register further includes instructions executable by the processor which, when executed by the processor, cause the active register to transmit the fan speed to the control hub.

What is claimed is:

1. A modular heat pump system for use in a building, comprising:

a first module, comprising:

an in-wall enclosure mountable within an exterior wall of the building and having an upper surface and an exterior-facing surface;

an indoor duct opening and an outdoor duct opening defined in the upper surface;

an outdoor air vent defined in the exterior-facing surface; and an interior-facing opening; and a second module dimensioned to be operatively received within the interior-facing opening of the first module, comprising:

a housing having at least an exterior-facing side, an upper side, and an interior-facing side;

an indoor air outlet defined in the upper side of the housing and positioned to mate with the indoor duct opening;

an outdoor air outlet defined in the upper side of the housing and positioned to mate with the outdoor duct;

an indoor air inlet defined in the interior-facing side; and an outdoor air inlet defined in the exterior-facing side and positioned to mate with the outdoor air vent.

2. The modular heat pump system in accordance with claim 1, wherein the second module further comprises:

an indoor coil disposed in an air path between the indoor air inlet and the indoor air outlet;

an indoor air mover positioned to draw indoor air from the indoor air inlet, through the indoor coil, and to the indoor air outlet;

an outdoor coil disposed between the outdoor air inlet and the outdoor air port;

an outdoor air mover positioned to move outdoor air from the outdoor air inlet, through the outdoor coil, and to the outdoor air port; and a compressor in fluid communication with the indoor coil and the outdoor coil.

3. The modular heat pump system in accordance with claim 1, further comprising an indoor duct extending upwardly from the indoor duct opening to an indoor duct outlet in communication with an interior space of the building.

4. The modular heat pump system in accordance with claim 1, further comprising an outdoor duct extending upwardly from the outdoor duct opening to an outdoor duct outlet positioned on an exterior wall of the building.

5. The modular heat pump system in accordance with claim 1, wherein the first module further comprises a condensate outlet port defined on the exterior-facing surface thereof; and the second module further comprises:

a first condensate pan positioned beneath the indoor coil;

a second condensate pan positioned beneath the outdoor coil, wherein the second condensate pan is positioned lower than the first condensate pan;

a pipe fluidly connecting the first condensate pan to the second condensate pan and configured to direct condensate to flow from the first condensate pan to the second condensate pan; and a condensate drain included in the second condensate pan and positioned to mate with the condensate outlet port of the first module.

6. The modular heat pump system in accordance with claim 1, wherein the first module further comprises a first electrical connector disposed in the cavity;

the second module further comprises a second electrical connector disposed thereupon and positioned to electrically engage the first electrical connector when the second module is fully operatively received within the first module.

7. The modular heat pump system in accordance with claim 6, wherein the first and second electrical connectors are selected from the group consisting of power connectors and data connectors.

8. The modular heat pump system in accordance with claim 1, wherein the second module comprises:

a processor;

a memory including instructions executable by the processor which, when executed by the processor, cause the processor to adjust the operation of the indoor fan, the outdoor fan, and/or the compressor; and a communications interface.

9. The modular heat pump system in accordance with claim 8, wherein the memory further includes instructions executable by the processor which, when executed by the processor, cause the processor to receive, via the communications interface, an operational parameter of second module and/or to transmit, via the communications interface, an operational status of the second module.

10. The modular heat pump system in accordance with claim 1, further comprising a peripheral dock having a data interface compatible with a device selected from the group consisting of a $CO_2$ sensor, a video camera, a smart phone, a lighting controller, room lights, an audio playback device, and a flat panel interface.

11. The modular heat pump system in accordance with claim 10, wherein the peripheral dock includes an electrical power connector.

12. The modular heat pump system in accordance with claim 1, wherein the indoor coil is divided into two sections that may be selectively coupled in a parallel configuration to facilitate a heating or cooling mode, or in a serial configuration to facilitate a dehumidification mode.

13. The modular heat pump system in accordance with claim 1, wherein the indoor air mover comprises a variable speed fan.

14. The modular heat pump system in accordance with claim 1, wherein the outdoor air mover comprises a variable speed centrifugal blower.

15. The modular heat pump system in accordance with claim 1, wherein the second module further comprises an handle provided on at least one side thereof.

16. The modular heat pump system in accordance with claim 1, further comprising a gasket that forms a seal between the outdoor air outlet and the outdoor duct opening.

17. The modular heat pump system in accordance with claim 1, further comprising a gasket that forms a seal between the indoor air outlet and the indoor duct opening.

18. The modular heat pump system in accordance with claim 1, further comprising a temperature and/or humidity sensor in operative communication with the second module and positioned within an interior space of the building.

19. The modular heat pump system in accordance with claim 1, further comprising a mobile device in operative communication with the second module and configured to enable a user to adjust an operational parameter of the modular heat pump system.

* * * * *